US006568781B2

(12) United States Patent
Moriyama

(10) Patent No.: US 6,568,781 B2
(45) Date of Patent: May 27, 2003

(54) INKJET RECORDING APPARATUS INCLUDING REMAINING AMOUNT OF INK DETECTING FUNCTION AND REMAINING AMOUNT OF INK DETECTING METHOD

(75) Inventor: Jiro Moriyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,095

(22) Filed: Oct. 29, 2001

(65) Prior Publication Data

US 2002/0075340 A1 Jun. 20, 2002

(30) Foreign Application Priority Data

Oct. 31, 2000 (JP) ..... 2000-332738

(51) Int. Cl.[7] ..... B41J 29/38
(52) U.S. Cl. ..... 347/14; 349/19
(58) Field of Search ..... 347/19, 14, 85, 347/80

(56) References Cited

U.S. PATENT DOCUMENTS

| | | | | |
|---|---|---|---|---|
| 4,636,814 A | | 1/1987 | Terasawa | 347/86 |
| 5,907,337 A | | 5/1999 | Tajika | 347/40 |
| 6,137,503 A | | 10/2000 | Hashimoto | 347/19 |
| 6,428,131 B1 | * | 8/2002 | Fujii et al. | 347/7 |
| 6,443,546 B1 | * | 9/2002 | Takagi | 347/7 |

FOREIGN PATENT DOCUMENTS

| | | |
|---|---|---|
| JP | 56-144184 | 11/1981 |
| JP | 60-24954 | 2/1985 |
| JP | 60-127162 | 7/1985 |
| JP | 2-102061 | 4/1990 |
| JP | 7-164626 | 6/1995 |

* cited by examiner

*Primary Examiner*—Lamson Nguyen
(74) *Attorney, Agent, or Firm*—Fitzpatrick, Cella, Harper & Scinto

(57) ABSTRACT

The present invention provides an inkjet recording apparatus and a method of detecting a remaining amount of ink capable of detecting an amount of ink remaining in an ink tank without the need of a special mechanism and part in an inkjet recording apparatus for recording an image by mounting the ink tank and a recording head on a carriage and scanning the carriage. The position where the carriage stops is detected by an encoder by moving the carriage by driving a motor and stopping the drive of the motor after the carriage constantly moves at a predetermined speed. The amount of ink remaining in the ink tank mounted on the carriage is determined based on the moving distance of the carriage from the time the drive of the motor is stopped to the time the carriage moved by inertia stops.

29 Claims, 5 Drawing Sheets

INKJET RECORDING APPARATUS INCLUDING REMAINING AMOUNT OF INK DETECTING FUNCTION AND REMAINING AMOUNT OF INK DETECTING METHOD

BACKGROUND OF THE INVENTION

1. Field of the Invention

The present invention relates to an inkjet recording apparatus for recording an image by ejecting ink and to a remaining amount of ink detecting method in the image recording apparatus.

2. Description of the Related Art

There is conventionally known a so-called serial type inkjet recording apparatus for recording an image by repeating a recording operation for recording an image in correspondence to one scan by canning an inkjet head acting as a recording means in a main scanning direction and a transport operation for transporting a recording medium in a sub-scanning direction different from the main scanning direction. Further, there are also known, as the serial type inkjet recording apparatus, an inkjet recording apparatus that has a carriage on which a print cartridge provided with an inkjet head integrated with an ink tank (hereinafter, referred to also as a "inkjet cartridge") is mounted and records an image by scanning the carriage in a main scanning direction relatively to a recording medium; and an inkjet recording apparatus that has an inkjet head arranged separately from an ink tank, mounts them on a carriage, and records an image by scanning the carriage.

The inkjet recording apparatus is widely utilized in a printer that prints an image based on a command output from an application program and the like installed on a computer acting as a host apparatus; in a copy machine that is integrated with a scanner for reading an image on a document and prints a copy of the image; in a facsimile for receiving, transmitting and outputting an image on a document through a signal line such as a phone line; and the like because it is easy to reduce the noise, running cost, and size of the inkjet recording apparatus.

The recording apparatus that records an image by the inkjet system employs various technologies to detect a remaining amount of ink in an ink tank mounted on the apparatus. Known as the technologies for detecting the remaining amount of ink are a method of optically detecting a liquid surface level of ink in an ink tank; a method of placing a buoyant float in an ink tank and detecting the position of the float using various sensors; a method of optically detecting an ejected ink droplet and determining whether or not ink is present based on whether or not ink is ejected; and the like.

Japanese Patent Laid-Open No. 2-102061 discloses a technology for detecting the absence of ink by a reflecting plate and a reflection type sensor that are disposed in an ink tank. Further, Japanese Patent Laid-Open No. 56-144184 discloses a technology for notifying the absence of ink after a predetermined period of time passes from the time it is detected as a countermeasure for preventing that the fluctuation of liquid surface of ink decreases an accuracy with which a remaining amount of ink is detected.

Furthermore, proposed as the technologies for detecting an amount of ink remaining in an ink tank are Japanese Patent Laid-Open No. 60-24954 which discloses a technology for determining that no ink is supplied due to the reduction in a remaining amount of ink by detecting the negative pressure in an ink supply pipe; Japanese Patent Laid-Open No. 60-127162 which discloses a technology for detecting an electric resistance between two electrodes disposed at positions where they are in contact with ink; Japanese Patent Laid-Open No. 07-164626 which discloses a technology for irradiating light to an ink tank, detecting light reflected thereon, and detecting the reduced state of an amount of ink in the ink tank; and so on.

As described above, the methods of detecting a remaining amount of ink in an ink tank and the methods of determining whether or not ink is present are conventionally well known. However, the method of detecting a liquid surface level in an ink tank may not obtain an accurate result of detection because of the fluctuation of a liquid surface, which is caused by the movement of a carriage, and surface tension. The method also requires complicated control to increases an accuracy. Further, in the method of optically detecting an ink droplet, a phenomenon, in which mist of tiny ink droplets is formed as ink droplets are ejected (hereinafter, simply referred to as "mist"), may occur as well as an ink droplet may be detected by mistake by the influence of dusts and the like. Thus, a result of detection may become unstable.

In particular, the conventional arrangements described above require to add a mechanism for detecting a remaining amount of ink, by which a problem is arisen in that the size of the inkjet recording apparatus and the cost thereof increase.

SUMMARY OF THE INVENTION

An object of the present invention, which was made in view of the above conventional examples, is to provide an inkjet recording apparatus capable of detecting a remaining amount of ink accurately without adding a new component to a conventional recording apparatus and without increasing a cost while maintaining the apparatus in a small size and to provide a remaining amount of ink detecting method.

To achieve the above object, the present invention is characterized in an inkjet recording apparatus that includes a carriage on which an ink accommodation unit for accommodating ink and a head unit for ejecting ink can be mounted; a main scanning unit for scanning the carriage along a main scanning direction by driving a motor; a position detection unit for detecting a position of the carriage that is scanned by the main scanning unit; a control unit for driving the motor to cause the main scanning unit to scan the carriage from a predetermined position in the scanning region of the carriage along the main scanning direction and then stopping the drive of the motor; and a determination unit for determining an amount of ink remaining in the ink accommodation unit based on a result of moving state of the carriage detected by the position detection nit after the drive of the motor is stopped by the control unit.

Further, to achieve the above object, the present invention is characterized in a method of detecting a remaining amount of ink in an inkjet recording apparatus including a carriage on which an ink accommodation unit for accommodating ink and a head unit for ejecting ink can be mounted and main scanning means for scanning the carriage along a main scanning direction by driving a motor, the method including the steps of scanning the carriage by the main scanning means from a predetermined position of the scanning region of the carriage along the main scanning direction by driving the motor; stopping the drive of the motor at predetermined timing while the carriage is being scanned at the scanning step; and determining the amount of ink remaining in the ink accommodation unit based on the moving state of the carriage after the stopping step.

According to the present invention, the amount of ink remaining in the ink accommodation unit can be determined based on the moving state of the carriage moved by inertia when the motor is stopped after the carriage, on which the ink accommodation unit for accommodating ink and the head unit are mounted, is scanned. As a result, the remaining amount of ink can be detected by a simple arrangement without the need of a special mechanism and part for detecting the remaining amount of ink.

Further objects, features and advantages of the present invention will become apparent from the following description of the preferred embodiments with reference to the attached drawings.

DESCRIPTION OF THE PREFERRED EMBODIMENTS

Preferable embodiments of the present invention will be described below with reference to the drawings.

(First Embodiment)

Figure 2:
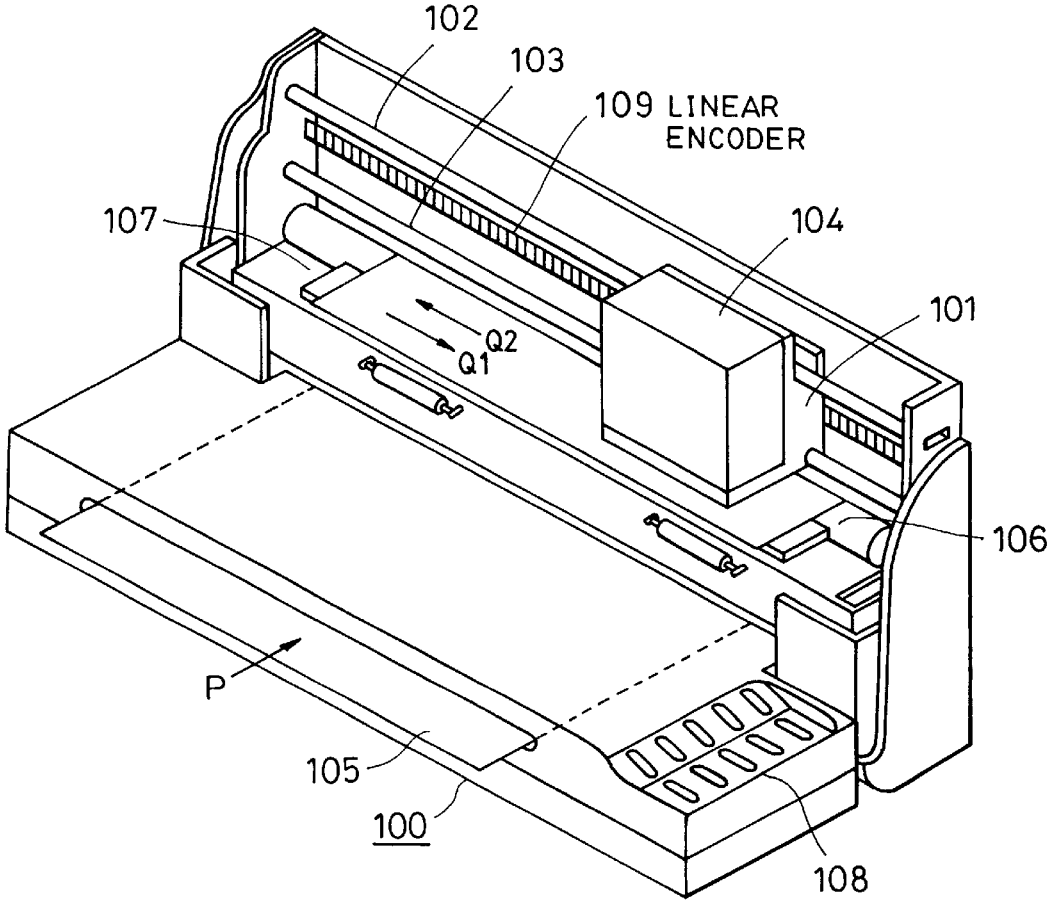
FIG. 2 is a schematic perspective view of an inkjet recording apparatus to which the present invention can be applied.
Figure 3:
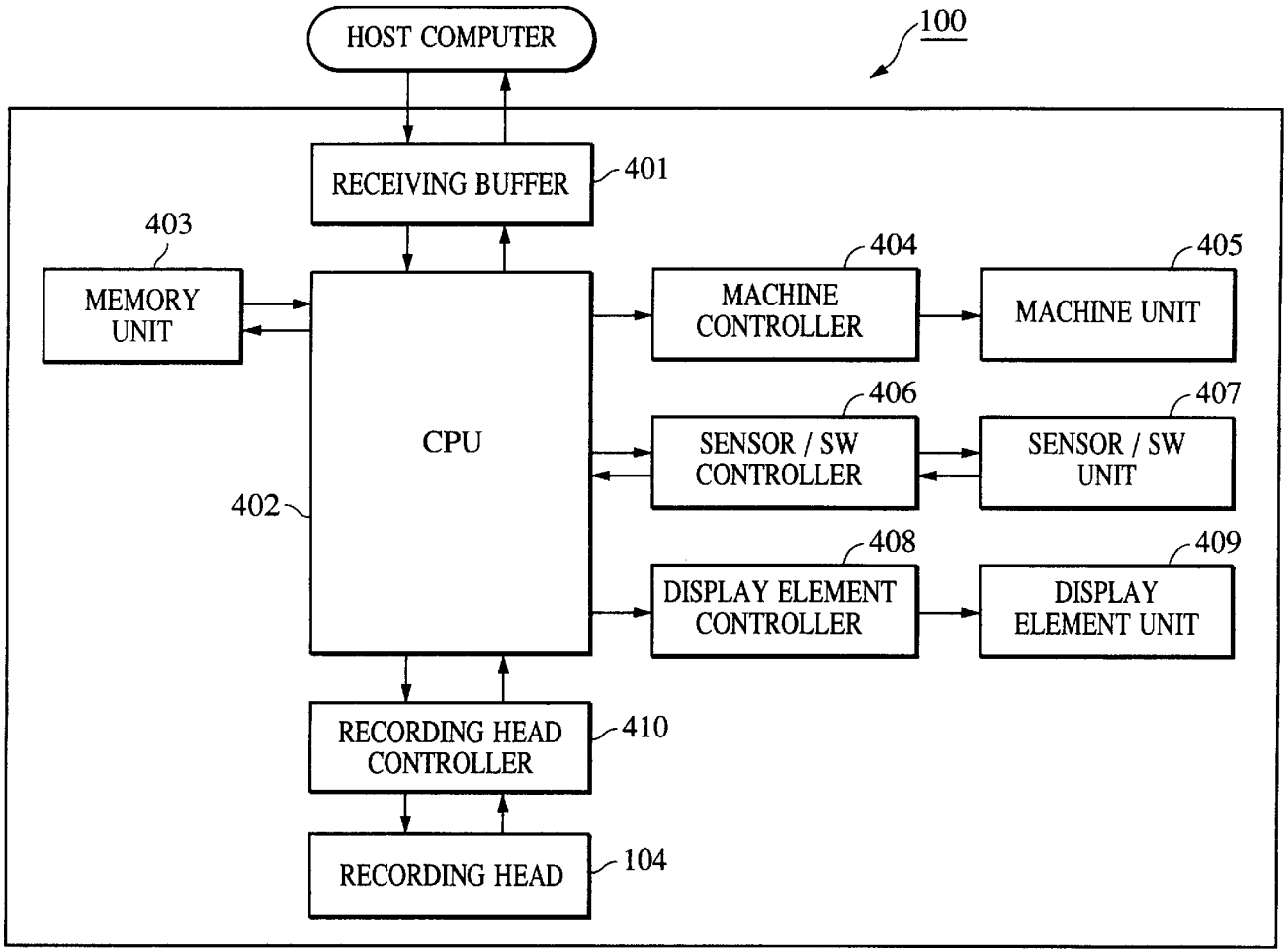
FIG. 3 is a block diagram of the inkjet recording apparatus to which the present invention can be applied.

FIG. 2 is a perspective view schematically showing a printer acting as an inkjet recording apparatus to which the present invention can be applied, and FIG. 3 is a block diagram showing the arrangement of the printer.

A recording medium 105 inserted to the sheet feed position of a recording apparatus 100 is sent in the direction of an arrow P by a feed roller 106 and transported to the record possible region of a recording head 104. A platen 107 is disposed under the recording medium 105 in the recording possible region. A carriage 101 can be moved by two guide shafts 102 and 103 in a direction along the axial directions thereof, and a scanning region including a recording region is reciprocatingly scanned in the directions shown by arrows Q1 and Q2 that are scanning directions by driving a not shown motor.

In FIG. 2, a head unit 104 (hereinafter, referred to also as a "recording head") mounted on the carriage 101 includes ejection ports capable of ejecting ink and an ink accommodation unit (hereinafter, referred to also as a "ink tank") for accommodating ink. Further, the recording head 104 is mounted on the carriage 101 so as to eject ink to the recording medium disposed therebelow and to record an image thereon, and the ejection ports are located on the lower side of the recording head 104. In FIG. 2, the ink ejected by the recording head 104 is black ink, and 128 pieces of the ejection ports are disposed on the recording head 104 in a single row to record an image with resolution of 360 dpi.

Further, reference numeral 108 shown in FIG. 2 denotes a switch unit and a display unit. The switch unit is used to turn on and off the power supply of the recording apparatus and to set various recording modes, whereas the display unit is used to display a state of the recording apparatus.

In FIG. 2, a linear encoder, which includes slits having a cycle of 300 dpi, is disposed behind the carriage 101 and can detect a position of the carriage 101 with an accuracy of 1/360 inch. A machine control unit 404 shown in FIG. 3 reciprocates the carriage 101 in a main scanning direction (the directions shown by the arrows Q1 and Q2) by operating the carriage motor of a machine unit 405. In the first embodiment, the carriage motor is a DC motor. In an ordinary print operation, a position of the carriage 101 or a moving speed of thereof is detected making use of a linear encoder 109 shown in FIG. 2 in such a manner that an optical sensor disposed behind the carriage 101 detects the slits disposed on the linear encoder 109 at predetermined intervals, the scanning speed of the carriage 101 can be kept constant by DC servo control. In the DC servo control, it is effective to use the linear encoder 109 to control the moving speed of the carriage 101 and to manage the position of the carriage 101. In the present invention, a remaining amount of ink is detected utilizing the linear encoder 109.

As described above, FIG. 3 is the block diagram of the inkjet recording apparatus to which the present invention can be applied. The data of a character and an image to be recorded is input to a reception buffer 401 of the recording apparatus 100 from a host computer 420. Further, data for confirming whether or not the data is appropriately transferred and data for notifying an operating state of the recording apparatus 100 are transmitted from the recording apparatus 100 to the host computer 420. Further, the data stored in the reception buffer 401 is transferred to a memory unit 403 under the management of a CPU 402 and temporarily stored in the RAM of the memory unit 403. The machine control unit 404 controls the drive of a machine unit 405 such as a carriage motor, a line fed motor, and the like in response to a command from the CPU 402. A sensor/switch controller 406 transfers the signals from a sensor/switch unit 407 composed of various sensors and switches to the CPU 402. A display element controller 408 controls a display unit 409 (hereinafter, referred to also as a "display elements unit") composed of the LEDs and the liquid crystal display elements of a display panel group in response to a command from the CPU 402. A recording head controller 410 controls the recording head 104 in response to a command from the CPU 402 and also detects temperature information and the like indicating a state of the recording head 104 and transfers them to the CPU 402.

Figure 1:
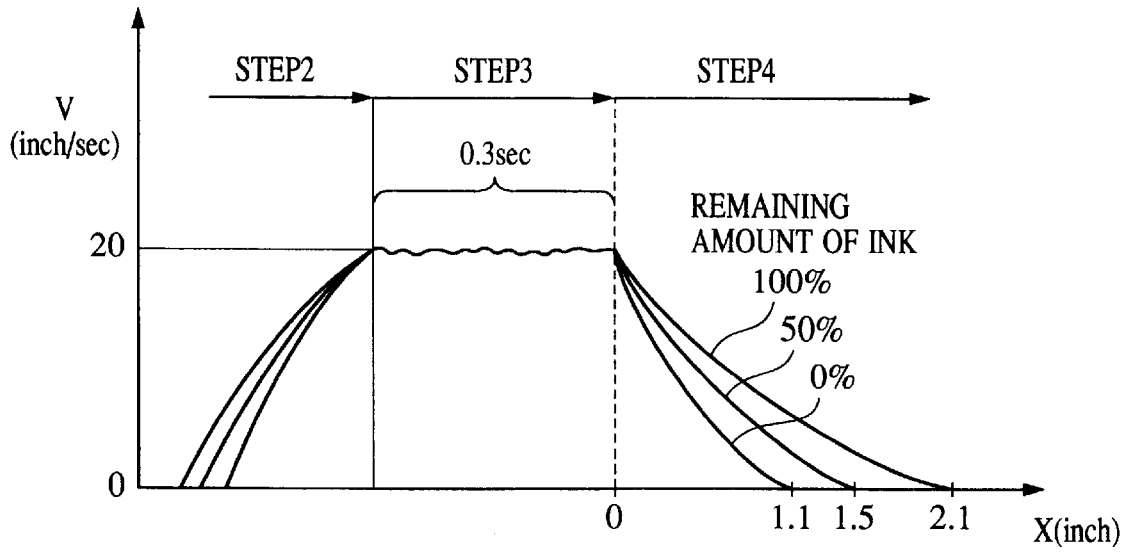
FIG. 1 is a graph showing the relationship between a remaining amount of ink and a moving distance of a carriage in a remaining amount of ink detection sequence according to a first embodiment.

FIG. 1 is a graph showing the movement of the carriage when a remaining amount of ink is measured in the first embodiment. In FIG. 1, the lateral axis shows a moving distance X of carriage and the vertical axis shows a moving speed V of the carriage. A sequence for measuring the remaining amount of ink will be described below. Note that the steps 2 to 4 of the respective steps described below are shown in correspondence to a position and a speed of the carriage 101 in FIG. 1.

First, at step 1 (not shown in FIG. 1), the carriage 101 on which the recording head 104 is mounted is moved to and stopped at a rightmost end shown in FIG. 2 (an end when the carriage 101 is moved in the direction of the arrow Q1 shown in FIG. 2). At step 2, the carriage 101 is moved in the direction of the arrow Q2 until the speed thereof reaches 20 inches/sec. At step 3, the carriage 101 is caused to travel at a constant speed of 20 inches/sec for 0.3 second. At step 4, the DC motor is released from a controlled state and placed in a free state. When the DC motor is released from the controlled state, that is, the control thereof is stopped, the carriage 101, which was moved under the control of the DC motor up to that time, is moved by inertia thereafter. At step 5 (not shown in FIG. 1), the moving distances of the carriage 101 from the initial state at step 4, that is, from the time the control of the DC motor was stopped to a time the carriage 101 stops are measured and shown by X1 (inch). At step 6, a remaining amount of ink at the present time is estimated from the relationship between a previously measured and known X1 and a remaining amount of ink. That is, when the above sequence is performed, the remaining amount of ink can be determined in such a manner that the values of X1 that correspond to predetermined remaining amounts of ink are previously measured and a remaining amount of ink corresponding to a value of X1 measured at step 5 is referred to.

In this system, the relationship between the previously measured and known values of X1 and the remaining amounts of ink is as shown in Table 1.

TABLE 1

| Remaining amount of ink (%) | X1 (inch) |
|---|---|
| 100 | 2.1 |
| 50 | 1.5 |
| 0 | 1.1 |

When a distance X1 measured in the above process is located between the values of X1 shown in Table 1, it is calculated by interpolation. That is, when the value of measured X1 is located between, for example, 2.1 (inch) and 1.5 (inch), an remaining amount of ink can be calculated according to these values.

Note that the drive of the motor for moving the carriage 101 can be controlled by the CPU 402 acting as a control means shown in FIG. 3 through the machine control unit 404, as described above. Further, when the information shown in Table 1 is stored in the memory unit 403 as a table, a remaining amount of ink can be determined by the CPU 402, which refers to the table stored in the memory unit 403, in correspondence to the X1 detected using the linear encoder 109 shown in FIG. 2.

Figure 5:
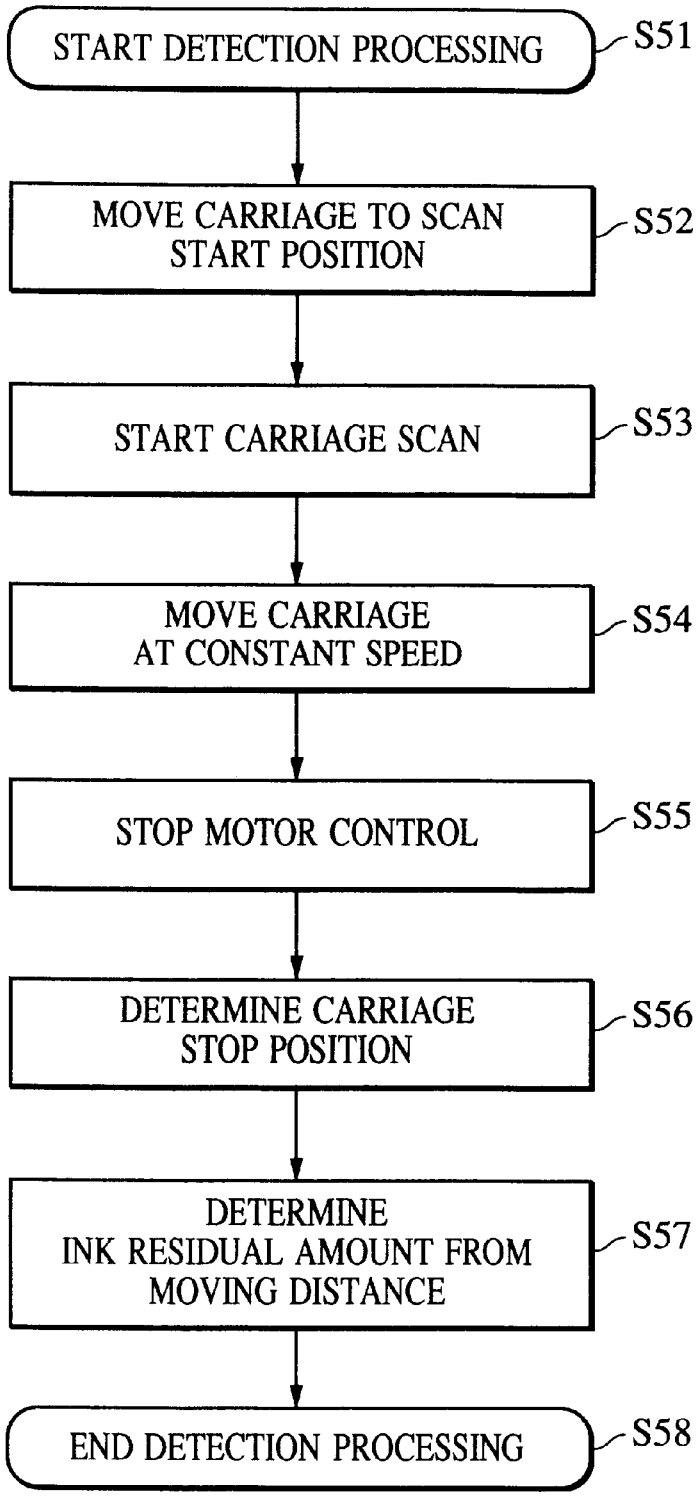
FIG. 5 is a flowchart explaining a process for detecting a remaining amount of ink according to the first embodiment.

Next, FIG. 5 shows a flowchart of the processes performed at steps 1 to 6. The flowchart will be described in correspondence to the respective steps shown in FIG. 5.

At step S51, when a remaining amount of ink detection process starts, the carriage 101 is moved to a predetermined scanning start position (step S52). At step S53, it is started to scan the carriage 101. After the carriage 101 is moved at a constant speed (step S54), the control of the motor is stopped at step S55. At step S56, the position where the carriage 101 is moved and stopped by inertia after the control of the motor is stopped is determined. The position where the carriage 101 stops can be accurately determined using the linear encoder 109 shown in FIG. 2. At step S57, the remaining amount of ink in the ink tank is determined based on the stop position determined at step S56, and the detection process is finished (step S58). In the finish operation of the detection process, the carriage 101 may be moved to a home position acting as a reference position in the apparatus.

It should be noted that while the remaining amount of ink is determined at step S57 with reference to Table 1, when the information shown by Table 1 is stored in, for example, a not shown memory means as a table, the remaining amount of ink can be determined by the process performed by the CPU 402.

As described above, a reason why the value of X1 changes according to a remaining amount of ink is that an inertial force changes depending upon an amount of ink remaining in the ink tank. Further, the value of X1 also changes according to the weight of the carriage 101, the weight of the recording head 104, the sliding property of the carriage 101, and the motor, a transmission system, and the like which are employed.

In the first embodiment, while it is described at step 1 to move and stop the carriage 101 to and at the rightmost position shown in FIG. 2, the present invention is not limited thereto. That is, the detecting operation may be started after the carriage 101 is moved to and stopped at the other end. Further, a predetermined position may be set in the scanning range of the carriage 101 and step 2 and subsequent steps may be performed from the position. It is preferable to appropriately set the position, to and at which the carriage 101 is moved and stopped prior to the detecting operation, according to the distance which the carriage 101 must move to determine the remaining amount of ink.

While the carriage 101 is caused to travel at the constant speed at step 3 in the arrangement described above, the step may be omitted when the traveling system of the carriage is stable. Further, when the state of the carriage in which it travels at a constant speed becomes stable in a relatively short time, the constant traveling time may be set to a short time according to the traveling system of the carriage 101.

While the motor is released from the controlled state set in the free state at step 4 in the arrangement described above, a minute voltage (current) may be applied to the motor to improve a measuring accuracy by increasing the moving distance of the carriage 101.

While the carriage is moved until it travels at the constant speed at step 2 in the arrangement described above, the motor may be driven for a predetermined period of time after the carriage begins to move.

While the above arrangement described using the DC motor as an example of the carriage drive motor for moving and scanning the carriage 101, a stepping motor, which rotates in response to a pulse applied thereto, may be used as the carriage drive motor. Note that when the stepping motor is employed, a relatively heavy load is applied to the carriage 101 when the motor is driven in a free state as compared with the DC motor. Thus, while the amount of X1, which shows the amount of movement of the carriage 101 after the motor is driven in the free state, is reduced, a remaining amount of ink can be determined in correspondence to the value of X1 similarly to the above arrangement.

Note that the recording head described in the first embodiment is a so-called bubble jet type recording head that ejects ink from nozzles by applying thermal energy to the ink. Each nozzle of the recording head is provided with a heating element for generating thermal energy for ejecting an ink droplet. The heating element is formed on a substrate composed of silicon etc. by a film forming technology. A protective film is formed on the heating element to prevent the direct contact of it with the ink. Further, the nozzles, ink liquid paths, ink liquid chambers, and the like are formed by laminating partition walls composed of a resin or glass material on the substrate. With this arrangement, the ink in a nozzle, which is abruptly heated by the heat generated by heating element, forms a bubble by film boiling. Thus, droplets of ink are ejected to a recording medium by the pressure generated when the bubble is created, whereby a character and an image can be formed.

The inkjet recording system using the heating element acting as an electrothermal converter is popularly called a bubble jet recording method because a bubble formed by the application of thermal energy is used when a droplet of ink is ejected.

Note that the present invention is not limited to the recording head employing the heating element and can be also applied to an inkjet recording apparatus employing a recording head using an ejection system making use of a piezoelectric element for mechanically applying pressure to ink.

(Second Embodiment)

Next, a second embodiment of the present invention will be described with reference to the drawings.

While the moving distance of the carriage is measured in the first embodiment, the moving speed of the carriage may be measured after, for example, a predetermined period of time passes from the time the carriage is moved freely by releasing the motor for moving and scanning the carriage from a controlled state.

Figure 4:
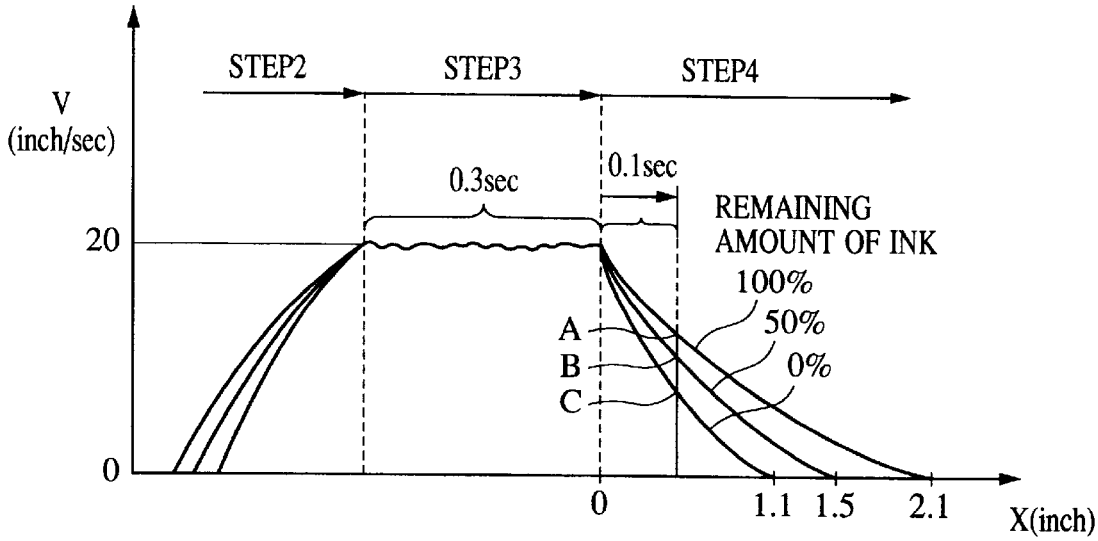
FIG. 4 is a graph showing the relationship between a remaining amount of ink and a speed of a carriage in a remaining amount of ink detection sequence according to a second embodiment.

FIG. 4 is a graph showing a process for measuring the speed of the carriage after 0.1 second passes from the time the control of the motor is stopped. In the figure, processes performed up to step 2 are the same as those in the first embodiment.

After the carriage moves constantly at a speed of 2.0 inches/sec at step 3 shown in FIG. 4, the drive control of the motor is interrupted, and, at step 4, the speed of the carriage is measured after 0.1 second passes from the time the drive control of the motor is interrupted. Lines A, B, and C shown in FIG. 4 correspond to the cases in which ink remains in the amounts of 100%, 50%, and 0%, respectively, and a larger remaining amount of ink corresponds to a higher speed of the carriage. Note that the speed of the carriage can be calculated by measuring a period of time necessary for the carriage to move a predetermined distance. The moving distance of the carriage can be measured with the linear encoder 109 shown in FIG. 2. That is, the moving speed of the carriage can be calculated by measuring the period of time which is necessary for the carriage to move between two predetermined positions detected by the linear encoder 109; or by detecting the positions between which the carriage moves in a predetermined time interval, after the drive of the motor is interrupted.

An effect, which can be obtained in the arrangement described in the second embodiment with respect the object of the present invention, is the same as that obtained in the arrangement of first embodiment in which the moving distance of the carriage until it stops is measured. In an arrangement in which the carriage moves a long distance after the control of the motor is interrupted because a frictional resistance is low when the carriage moves, the arrangement shown in FIG. 4 permits a remaining amount of ink to be determined in a relatively short time as compared with the arrangement of the first embodiment.

Note that the remaining amount of ink can be determined by previously storing values corresponding to remaining amounts of ink (for example, moving speeds of the carriage) in a memory or the like as a table and referring to the table in correspondence to a result of measurement, similarly to the first embodiment.

The present invention is not limited to the arrangement of the second embodiment. That is, at step 5 described in the first embodiment, the period of time necessary at step 4, that is, the period of time from the time the control of the motor is stopped to the time the carriage is stopped may be measured in place of measuring the value of X1.

Further, it is possible to apply various modifications to the processes performed at steps 1 to 4, similarly to the first embodiment.

(Third Embodiment)

A third embodiment relates to an arrangement for permitting a remaining amount of ink to be detected with a pinpoint accuracy without being affected by the variation of friction of a mechanical structure for moving and scanning the carriage even if the friction of the structure varies.

There is a tendency that a decrease in temperature increases the frictional force of the mechanical structure. In contrast, the decrease in temperature decreases the resistance of the winding of the motor and increases the torque of the motor. An increase in temperature causes opposite results.

In the arrangements described in the first and second embodiments, there is a possibility that the accuracy with which a remaining amount of ink is detected is affected by the factors which are varied by temperature. To cope with this problem, the third embodiment permits the remaining amount of ink to be determined accurately without being affected by the variation in temperature by modifying or correcting the values shown in Table 1 described in the first embodiment by the temperature of the recording apparatus.

It is sufficient to perform temperature correction by previously measuring the values of Table 1 at three types of temperature, that is, at 25° C. which is an ordinarily used temperature, a low temperature of 15° C., and a high temperature of 35° C.

(Fourth Embodiment)

The arrangements for accurately measuring a remaining amount of ink have been described in the embodiments described above.

A fourth embodiment is to determine whether or not a cartridge, which is integrated with the ink tank or with the ink tank and the recording head, is replaced. When it is determined whether or not the cartridge mounted on the carriage is replaced, a high detection accuracy is not necessary as compared with the case in which a remaining amount of ink is detected, and it is possible to determine whether or not the cartridge is replaced by comparing, for example, a value of X1 with a predetermine threshold value.

A high measuring accuracy is not necessary because whether or not the cartridge is replaced can be determined by discriminating between remaining amounts of ink of 0% and 100% when the recording apparatus is in an ordinary operation. Further, even if measured values vary depending upon circumferential conditions under which the recording apparatus is used, when values, which are measured in a short time difference, are compared with each other, the variation of the measured values caused by a circumstance can be absorbed. It is possible to make rough measurement even if a measuring accuracy is bad in a system in which, for example, the tolerance of mechanical processing is bad.

A measuring sequence in the fourth embodiment will be described below.

An inkjet recording apparatus to which the fourth embodiment can be applied is the same as that shown in FIGS. 2 and 3. Thus, the arrangement of the recording apparatus in the fourth embodiment will be described with reference to FIG. 2.

The inkjet recording apparatus of the fourth embodiment is arranged such that when no image is recorded, a carriage 101 stops at a home position set at the right end in FIG. 2, that is, the end moved in the direction of the arrow Q1 of FIG. 2. In contrast, when a user replaces an ink tank, the carriage 101 is moved to a replacing position set at a center in response to the depression of the tank replacement switch of a sensor/switch unit of the recording apparatus. While the carriage 101 is being moved to the center in response to the replacement command, the value of X1 described above is measured by the method described in the first embodiment and stored as X2. When the carriage 101 moves to the center, the user can replace the ink tank. On the completion of the replacement possible state, the value of X1 is measured again by the method described in the first embodiment and stored as X3. When the following formula is established here, it is determined that the ink tank is normally replaced, whereas when the formula is not established, it is determined that the ink tank is not normally replaced.

$$X2+\Delta X<X3$$

where, ΔX shows a designed margin. A reason why it is necessary to determine whether or not the ink tank is normally replaced is to prevent the occurrence of irregular cases as described below. That is, there can be assumed such irregular cases that while the user intends to replace the ink tank, he or she cannot replace it because a new ink tank is not available; and that the tank replacement switch is depressed by mistake.

When it is determined that the ink tank is normally replaced in the above process, a remaining amount of ink counter disposed in the recording apparatus is set to 100% (the counter is reset). Otherwise, it is determined the state before the tank replacement switch is depressed is maintained, and the remaining amount of ink counter is not renewed from the state before the replacement switch is depressed. The remaining amount of ink counter disposed in the recording apparatus is a counter for predicting an amount of ink used by the number of printed sheets, duty, and the like.

As described above, the remaining amount of ink counter can be automatically reset by the system of the fourth embodiment. Conventionally, it is necessary, for example, to provide an ink tank mounting sensor or for the user to depress a reset button after the ink tank is replaced. The sensor in the former arrangement is a factor for increasing cost, and the reset button in the latter arrangement causes a malfunction in that the user forgets to depress it and that it is depressed by mistake.

(Other Embodiments)

The embodiments of the present invention have been described taking such an arrangement as an example that the linear encoder having the slits is utilized to detect a position of the carriage and the optical sensor provided with the carriage detects the position of the carriage. However, the present invention is not limited thereto and may be arranged using a magnetic type encoder.

Further, the embodiments have been described taking the arrangement of the ink tank which is separable from the recording head as an example. However, the present invention is not limited thereto and can be also applied to a cartridge type recording head in which the ink tank is integrated with the recording head.

The embodiments of the present invention have been described using the example in which the ejection system employs the electrothermal converter for applying thermal energy to a liquid as the arrangement for ejecting the liquid. However, the present invention is not limited thereto and can be also applied to an inkjet recording apparatus employing other conventionally known ejection systems. Ordinarily known as one of the other ejection systems is a system that employs a piezo element as an electromechanical conversion element for applying mechanical pressure as ejection energy and ejects a droplet of liquid by the pressure generated by the piezo element.

The present invention achieves an excellent effect particularly in a recording apparatus using a so-called bubble jet type recording head for receding an image by forming a flying droplet of liquid making use of thermal energy among the inkjet recording systems.

Further, it is preferable to add a recovery means, a preliminary auxiliary means, and the like, which are disposed as an arrangement of the recording apparatus of the present invention, to the recording head because the effect of the present invention can be more stabilized thereby. These means are specifically exemplified as a capping means, cleaning means, pressurizing or suction means, and preliminary heating means provided with the recording head, the preliminary heating means being composed of an electrothermal converter, a heating element other than the electrothermal converter, or a combination thereof. It is also effective to the stable recording of an image to perform a preliminary ejection mode in which ink is ejected for a purpose other than recording.

Further, as to a type and a number of recording heads to be mounted, the present invention can be applied to any of the arrangement in which one recording head is provided in correspondence to single color and the arrangement in which two or more recording heads are provided in correspondence to a plurality of inks having different recording color and density.

While the ink is described as a liquid in the embodiments of the present invention described above, ink, which is solidified at a room temperature or less and softened or liquefied at the room temperature may be used. Otherwise, ink, which is liquefied when a recording signal to be used is applied thereto, may be used because the temperature of ink itself is ordinarily adjusted in the range from 30° C. or more to 70° C. or less in the inkjet system to set the viscosity of the ink in a stably ejecting range. In addition to the above-mentioned, ink, which is solidified when it is left as it is and liquefied by being heated, may be used to positively prevent an increase in temperature of the ink or to prevent the evaporation of the ink by using the temperature of the ink increased by thermal energy as energy for changing the ink from a solidified state to a liquefied state. In any case, the present invention can be also applied to a case in which used is ink having such a property that it is liquefied for the first time when thermal energy is applied thereto, for example, ink which is liquefied by the thermal energy applied thereto according to a recording signal and is ejected in a liquid state, ink which begins to solidity at the time it reaches a recording medium, and the like. This type of ink may confront an electrothermal converter in a state in which it is held in the recesses or through holes of a porous sheet, which is disclosed in Japanese Patent Laid-Open No. 54-56847 or 60-71260, as a liquid or a solid. In the present invention, the aforementioned film boiling system can be most effectively executed to the respective inks described above.

The inkjet recording apparatus of the present invention may be used as a copy machine combined with a reader, and the like and further as a facsimile having a transmission/reception function, in addition to that it is used as an image output terminal of image processing equipment such as a computer and the like.

Further, the present invention may be applied to a system composed of a plurality sets of equipment or to an apparatus composed of a single set of equipment.

Furthermore, it is needless to say that the object of the present invention can be also achieved by supplying a recording medium, on which the program codes of software for realizing the functions of the aforementioned embodiments are recorded, to a system or an apparatus and by reading and executing the program codes stored in the recording medium by the computer (or the CPU or the MPU) of the system or the apparatus.

In this case, since the program codes themselves read from the recording medium realize the functions of the aforementioned embodiments, the recording medium on which the program codes are stored constitutes the present invention.

A floppy disc, hard disc, optical disc, magnetic optical disc, CD-ROM, CD-R, magnetic tape, non-volatile memory card, ROM, and the like, for example, may be used as the recording medium for supplying the program codes.

Further, it is needless to say that the present invention also includes a case in which not only the functions of the aforementioned embodiments are realized by executing the program codes read by the computer but also an operating system running on a computer and the like partly or entirely performs an actual process based on a command from the program codes and the functions of the embodiments are realized by the process.

Furthermore, it is needless to say that the present invention also includes a case in which after the program codes read from the recording medium are written in a memory provided with a function expanding board inserted into the computer or with a function expanding unit connected to the computer, a CPU or the like provided with the function expanding board or the function expanding unit partly or entirely performs an actual process based on a command from the program codes and the functions of the embodiments are realized by the process.

As to the respective embodiments described above in detail, the first embodiment is arranged such that a remaining amount of ink is determined based on the position where the carriage stops which is moved by inertia after the drive control of the motor is stopped; and the second embodiment is arranged such that a remaining amount of ink is determined based on the speed of the carriage which is moved by inertia after the drive control of the motor is stopped. As described in the embodiments, the present invention pays attention to that an amount of movement of the carriage, which is moved by inertia after the drive of the motor is stopped while the carriage is traveling, varies according to a remaining amount of ink in the ink tank acting as the ink accommodation unit. Accordingly, the present invention has such a feature that the drive of the motor is stopped after the carriage is moved by driving the motor; the moving state of the carriage, which is moved by inertia after the motor is stopped, is detected; and a remaining amount of ink is determined from a result of moving state detected.

Note that the present invention is by no means limited to the aforementioned embodiments and it goes without saying that various modifications can be made by a person skilled in the art.

As described above, according to the present invention, it is possible to detect a remaining amount of ink without newly adding any remaining amount of ink detecting mechanism and without increasing the size of the recording apparatus and the cost thereof.

Further, it is possible to determine whether or not the ink tank is appropriately replaced without additionally providing a switch and without the need of a remaining amount of ink reset operation, whereby the remaining amount of ink can be properly monitored.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An inkjet recording apparatus, comprising:

a carriage on which an ink accommodation unit for accommodating ink and a head unit for ejecting ink can be mounted;

main scanning means for scanning the carriage along a main scanning direction by driving a motor;

position detection means for detecting a position of the carriage that is scanned by the main scanning means;

control means for driving the motor to cause the main scanning means to scan the carriage from a predetermined position in the scanning region of the carriage along the main scanning direction and then stopping the drive of the motor; and determination means for determining an amount of ink remaining in the ink accommodation unit based on a result of moving state of the carriage detected by the position detection means after the drive of the motor is stopped by the control means.

2. An inkjet recording apparatus according to claim 1, wherein the determination means determines the amount of ink remaining in the ink accommodation unit based on a result of detection of the position, at which the carriage stops, detected by the position detection means after the drive of the motor is stopped by the control means.

3. An inkjet recording apparatus according to claim 1, wherein the determination means determines the amount of ink remaining in the ink accommodation unit based on a result of measurement of the distance from the position where the drive of the motor is stopped by the control means to the position where the carriage is stopped.

4. An inkjet recording apparatus according to claim 3, wherein the determination means determines the amount of ink remaining in the ink accommodation unit by referring to a table in which the remaining amount of ink in the ink accommodation unit corresponds to the distance.

5. An inkjet recording apparatus according to claim 1, wherein the determination means determines the amount of ink remaining in the ink accommodation unit based on the moving speed of the carriage after a predetermined period of time passes from the time the drive of the motor is stopped by the control means.

6. An inkjet recording apparatus according to claim 5, wherein the moving speed of the carriage after the predetermined period of time passes is calculated based on the position of the carriage detected by the position detection means.

7. An inkjet recording apparatus according to claim 5, wherein the determination means determines the amount of ink remaining in the ink accommodation unit by referring to a table in which the remaining amount of ink in the ink accommodation unit correspond to the moving speed.

8. An inkjet recording apparatus according to claim 1, wherein the determination means determines the amount of ink remaining in the ink accommodation unit based on the period of time from the time the drive of the motor is stopped to the time the movement of the carriage is stopped.

9. A recording apparatus according to claim 1, wherein the control means stops the drive of the motor after the carriage is accelerated to a predetermined speed by driving the motor.

10. A recording apparatus according to claim 9, wherein the control means stops the drive of the motor when the carriage moves for a predetermined period of time at the predetermined speed after it is accelerated to the predetermined speed.

11. A recording apparatus according to claim 1, wherein the motor is a DC motor.

12. An inkjet recording apparatus according to claim 1, wherein the position detection means detects the position of the carriage by an encoder having slits disposed at predetermined intervals along the main scanning direction and a sensor disposed to the carriage for detecting the slits.

13. An inkjet recording apparatus according to claim 1, wherein the ink accommodation unit is arranged integrally with the head unit.

14. An inkjet recording apparatus according to claim 1, wherein the ink accommodation unit is arranged separately from the head unit.

15. An inkjet recording apparatus according to claim 1, wherein the head unit comprises ejection ports for ejecting ink and an electrothermal converter for ejecting ink from the ejection ports, and ink is ejected from the ejection ports by generating bubbles in the ink by driving the electrothermal converter.

16. A method of detecting a remaining amount of ink in an inkjet recording apparatus comprising a carriage on which an ink accommodation unit for accommodating ink and a head unit for ejecting ink can be mounted and main scanning means for scanning the carriage along a main scanning direction by driving a motor, comprising the steps of:

scanning the carriage by the main scanning means from a predetermined position of the scanning region of the carriage along the main scanning direction by driving the motor;

stopping the drive of the motor at predetermined timing while the carriage is being scanned at the scanning step; and determining the amount of ink remaining in the ink accommodation unit based on the moving state of the carriage after the stopping step.

17. A method of detecting a remaining amount of ink according to claim 16, wherein the determination step determines the amount of ink remaining in the ink accommodation unit based on a result of detection of the position where the carriage stops after the drive of the motor is stopped.

18. A method of detecting a remaining amount of ink according to claim 16, wherein the determination step measures the distance from the position where the drive of the motor is stopped to the position where the carriage is stopped based on a result of detection of the position of the carriage and determines the amount of ink remaining in the ink accommodation unit based on the measured distance.

19. A method of detecting a remaining amount of ink according to claim 18, wherein the determination means determines the amount of ink remaining in the ink accommodation unit by referring to a table in which the amount of ink remaining in the ink accommodation unit corresponds to the distance.

20. A method of detecting a remaining amount of ink according to claim 16, wherein the determination means determines the amount of ink remaining in the ink accommodation unit based on the moving speed of the carriage after a predetermined period of time passes from the time the drive of the motor is stopped.

21. A method of detecting a remaining amount of ink according to claim 20, wherein the moving speed of the carriage after the predetermined period of time passes is calculated based a result of detection of the position of the carriage.

22. A method of detecting a remaining amount of ink according to claim 20, wherein the determination means determines the amount of ink remaining in the ink accommodation unit by referring to a table in which the amount of ink remaining in the ink accommodation unit corresponds to the moving speed.

23. A method of detecting a remaining amount of ink according to claim 16, wherein the determination means determines the amount of ink remaining in the ink accommodation unit based on the period of time from the time the drive of the motor is stopped to the time the movement of the motor is stopped.

24. A method of detecting a remaining amount of ink according to claim 16, wherein the drive of the motor is stopped after the carriage is accelerated to a predetermined speed by driving the motor.

25. A method of detecting a remaining amount of ink according to claim 24, wherein the drive of the motor is stopped when the carriage moves for a predetermined period of time at the predetermined speed after it is accelerated to the predetermined speed.

26. A method of detecting a remaining amount of ink according to claim 16, wherein the motor is a DC motor.

27. A method of detecting a remaining amount of ink according to claim 16, wherein when the amount of ink remaining in the ink accommodation unit is determined at the determination step, the position of the carriage is detected by position detection means comprising an encoder having slits disposed at predetermined intervals along the main scanning direction and a sensor disposed to the carriage for detecting the slits.

28. A method of detecting a remaining amount of ink according to claim 16, wherein the ink accommodation unit is arranged integrally with the head unit.

29. A method of detecting a remaining amount of ink according to claim 16, wherein the ink accommodation unit is arranged separately from the head unit.

* * * * *

UNITED STATES PATENT AND TRADEMARK OFFICE

CERTIFICATE OF CORRECTION

PATENT NO. : 6,568,781 B2
DATED : May 27, 2003
INVENTOR(S) : Jiro Moriyama

It is certified that error appears in the above-identified patent and that said Letters Patent is hereby corrected as shown below:

Column 1,
Line 18, “canning” should read -- scanning --.

Column 2,
Line 17, “an accuracy.” should read -- in accuracy. --.
Line 25, “to” should be deleted; and “Add” should read -- Adding --.
Line 26, “is arisen” should read -- arises --.
Line 51, “of” should read -- of the --.

Column 3,
Line 53, “a not” should read -- a motor --.
Line 54, “shown motor.” should read -- (not shown). --.

Column 4,
Line 15, “of thereof” should read -- thereof --.

Column 5,
Line 64, “a not” should read -- a memory means --.
Line 65, “shown memory means” should read -- (not shown) --.

Column 6,
Line 55, “etc.” should read -- etc., --.
Line 62, “heating” should read -- the heating --.

Column 7,
Line 5, “be” should read -- also --.
Line 6, “also” should read -- be --.
Line 43, “respect” should read -- respect to --.
Line 45, “of” should read -- of the --.

Column 9,
Lines 51 and 59, “be also” should read -- also be --.

Column 10,
Line 1, “receding” should read -- recording --.
Line 20, “arrangement” should read -- arrangements --.
Line 40, “be also” should read -- also be --; and “used” should read -- ink --.
Line 41, “ink” should read -- used --.
Line 45, “solidity” should read -- solidify --.
Line 60, “plurality” should read -- plurality of --.
Line 63, “be also” should read -- also be --.

UNITED STATES PATENT AND TRADEMARK OFFICE

CERTIFICATE OF CORRECTION

PATENT NO. : 6,568,781 B2
DATED : May 27, 2003
INVENTOR(S) : Jiro Moriyama

It is certified that error appears in the above-identified patent and that said Letters Patent is hereby corrected as shown below:

Column 11,
Line 39, “an” should be deleted.
Line 48, “of” should read -- of the --.

Column 12,
Line 57, “correspond” should read -- corresponds --.
Lines 63 and 66, “A recording” should read -- An inkjet recording --.

Column 13,
Line 4, “A recording” should read -- An inkjet recording --.

Signed and Sealed this

Third Day of February, 2004

JON W. DUDAS
*Acting Director of the United States Patent and Trademark Office*